United States Patent [19]

Scuccato et al.

[11] 4,433,769

[45] Feb. 28, 1984

[54] GRINDING MILL CONTROL SYSTEM

[75] Inventors: Serge L. Scuccato, Peterborough; Marvin B. Shaver, Beaconsfield, both of Canada

[73] Assignee: Dominion Engineering Works Limited, Lachine, Canada

[21] Appl. No.: 286,627

[22] Filed: Jul. 24, 1981

Related U.S. Application Data

[63] Continuation-in-part of Ser. No. 81,032, Oct. 1, 1979, abandoned.

[30] Foreign Application Priority Data

Oct. 13, 1978 [CA] Canada ..... 313334

[51] Int. Cl.[3] ..... B60K 41/02; F16H 37/06

[52] U.S. Cl. ..... 192/0.098; 74/665 B

[58] Field of Search ..... 192/0.032, 0.033, 0.098, 192/0.096, 0.076, 0.048, 0.042, 0.02 R, 0.094, 103 R, 52; 74/665 B, 665 A, 665 R, 813 C, 822, 816

[56] References Cited

U.S. PATENT DOCUMENTS

| | | | |
|---|---|---|---|
| 2,838,913 | 6/1958 | Peterson et al. | 192/87.13 X |
| 2,962,147 | 11/1960 | Klyce | 74/816 X |
| 3,173,526 | 3/1965 | Eakin | 74/661 X |
| 3,369,636 | 2/1968 | Nelson . | |
| 3,390,585 | 7/1968 | Henne | 74/661 X |
| 3,512,425 | 5/1970 | Endo | 74/665 B |
| 3,548,987 | 12/1970 | Erickson | 192/87.12 |
| 3,734,257 | 5/1973 | Eastcott et al. | 192/87.13 |
| 3,757,912 | 9/1973 | Ball et al. | 192/0.098 X |
| 4,298,113 | 11/1981 | Shaver | 192/0.098 X |
| 4,377,222 | 3/1983 | Sommer | 192/0.098 |

*Primary Examiner*—George H. Krizmanich

*Attorney, Agent, or Firm*—Raymond A. Eckersley

[57] ABSTRACT

A grinding mill such as an autogenous mill or ball mill, having a large driving gear driven by two motors, wherein a soft start capability is provided by a clutch or clutches, is "finger-printed" in relation to the reduction gear system in order to identify optimum conditions for locking up the drive to achieve substantially equal loading between the drive motors, and to diminish cyclic variations in loading between the motors.

4 Claims, 5 Drawing Figures

GRINDING MILL CONTROL SYSTEM

This invention is directed to a grinding mill drive system, and to a method of operating the system.

This application is a continuation-in-part of application Ser. No. 81,032, filed Oct. 1, 1979, now abandoned.

In the provision of grinding mills, the increase in mill sizes has led to the adoption of multiple electric motors connected by geared transmission to the mill. It has been found that certain advantages derive from the provision of suitable fluid actuated clutches connecting the driving motors with output pinions running in constant mesh with the main gear. Thus the provision of such clutches enables soft starts of the mill to be made; also, the adoption of synchronous motors becomes practical, while the sharing of load between the motors may be regulated.

The use of clutches for balancing load between plural electric motors is well typified in U.S. Pat. Nos. 3,369,636, Feb. 20, 1968, Nelson, assigned to the assignee of the present application, and 3,757,912, dated Sept. 11, 1973, Ball et al.

It has been found, owing to the inaccuracies generally present in reduction gears of the size and type used in this manner of installation, that effecting lock-up of the driving motors to the gear system for a particular position or positions of the main gear wheel can effectively reduce cyclic load variations between the motors.

Thus, in the case of mill having a pair of driving pinions positioned diametrically opposite each other in relation to the main gear, there are generally two positions of the main gear, in relation to a fixed datum, where lock-up of the transmission will achieve minimum cyclic load variation, so as to substantially minimize the instantaneous difference in load cyclicly occurring between a pair of drive motors, during each revolution of the mill.

Conversely, by locking up the system at disadvantageous locations, as could readily happen in past practice of indiscriminate lock-up, the cyclic load variations could be emphasized, such that instantaneous load imbalance as high as 10% between the two synchronous motors has been known.

The present invention provides a mill drive system having a mill drum rotatably mounted between spaced bearings, a large gear directly connected to the drum in driving relation, at least two pinion gears mounted in constant meshing relation with the large gear, at least one electric motor to drive each of the gears, variable clutch means to permit regulation of power transmission between the motors and the pinion gears, and angular position indicating datum means relating the instantaneous rotational position of the large gear to a fixed datum to permit selective operation of the clutch means in locking up of the motors to the gears for at least one preselected position of the large gear relative to the datum, whereby cyclic variation of loading of the respective motors is substantially minimized.

Thus there is provided a method of controlling the operation of a large gear in driving relation with a load, having at least one clutch in connecting relation between a first electric motor and a pinion gear positioned in driving relation with the large gear, and a second electric motor connected in driving relation with the large gear, including the step of locking-up the clutch at a predetermined rotational position of the large gear, to synchronize operation of the motors with the gear, whereby cyclic variations of loading on the motors due to non-uniform characteristics of the system are substantially minimized.

Certain embodiments of the invention are described, reference being made to the accompanying drawings wherein.

Figure 1:
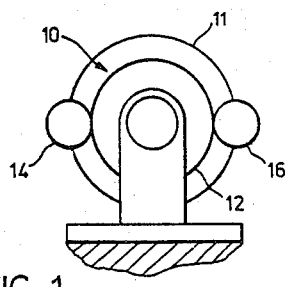
FIG. 1 is a schematic arrangement showing a main gear and a pair of diametrically opposed pinion gears.

Referring to FIG. 1 the arrangement 10 comprises a large gear wheel 12 attached to a mill drum having a pair of pinion wheels 14, 16 arranged in meshing relation with the gear wheel 12. In the illustrative arrangement the pinions 14, 16 are arranged diametrically opposite one another, being therefore, so to speak, at the zero and 180° position respectively of the large gear wheel 12.

Figure 2:
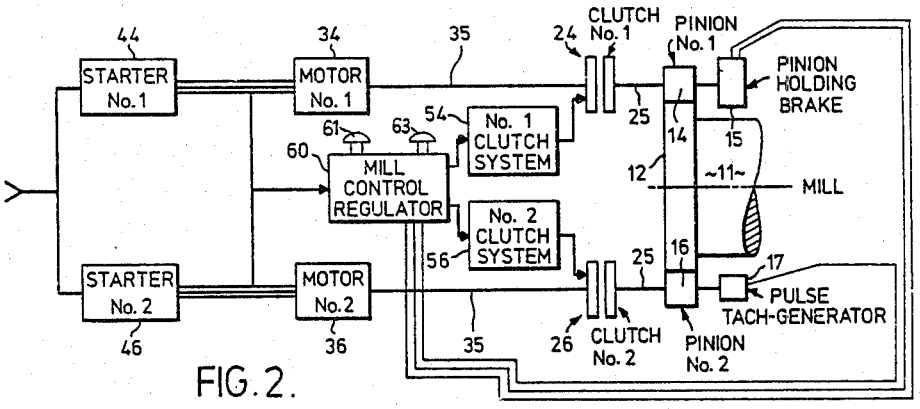
FIG. 2 is a schematic arrangement showing a drive system incorporating two clutches and motors.

Turning to FIG. 2, the large gear wheel 12 is mounted in direct driving relation with the drum 11 of a mill.

Each pinion gear 14, 16 is illustrated as having a driveline, with clutches 24, 26 connected by shafts 25 in driving relation with the respective pinions.

Drivelines 35 connect each clutch 24, 26 on its input side with an electric motor 34, 36. The motors illustrated are synchronous motors, because primary advantages of the present system are achieved by use of synchronous motors. Each motor 34, 36 has a respective starter 44, 46, by means of which the motors may be brought up to speed.

The pinion 14, referred to as No. 1 pinion is provided with a holding brake 15, and pinion 16 referred to as No. 2 pinion is provided with a pulse tachometer generator 17.

Figure 3:
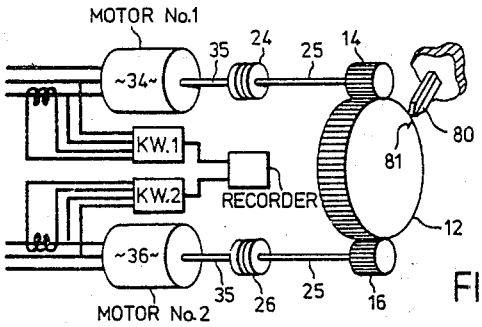
FIG. 3 shows a portion of the FIG. 2 arrangement with provision to record a "fingerprint" of the mill under load.

The clutches 24, 26 are each provided with a clutch control system 54, 56 each having a mill control regulator 60 connected in regulating relation therewith. Turning to FIG. 3, the provisions for recording the instantaneous power consumptions of the motors 34, 36 during steady state running for an actual mill installation are illustrated, with the recorded output, shown diagrammatrically in FIG. 4, being a cyclic load variation characteristic for the installation.

The regulator 60 is illustrated as having a START button 61 and a RUN button 63.

While illustrated for the full load condition, it will be understood that the same characteristic variation of motor power with mill position will prevail at lower mill charge loadings.

In accordance with established practice, particularly in the case of synchronous motors, the motors are first run up to speed, with the clutches disengaged, so that motor starting conditions are optimized for across-line starting. With the motors up to speed, and in the case of synchronous motors, locked in synchronism to the bus bars, the clutches 24, 26 are selectively energized by operation of the start button 61, to apply a soft start and bring the mill 11 up to speed.

In effecting a soft start of the mill, with the motors running at synchronous speed on the bus bars, by actuating START button 61 the clutches 24, 26 are engaged, to a predetermined torque load value, being automatically individually slipped as necessary, in order to achieve balanced loading and provide the desired mill starting torque to the pinions 14, 16.

Thus, the synchronous speed of the motors, if coupled directly through the gears to the mill, would produce a corresponding "full speed" for the mill.

In order to effect a soft start of the mill, while accelerating it to full speed by way of the two motors operating at synchronous speed, the gross difference in speed across the system, as represented by the fixed synchronous motor speed at the input sides of the clutches compared to the actual mill speed equivalent, appearing at the clutch output sides, is accommodated by gross slippage in the clutches. The degree of slippage is expressed as a selected torque output, the predetermined torque output selected having a value such as 130% of full load torque. (Full load torque is that torque which would be required to drive the mill when running at full speed, discussed above.)

Thus, the gross slippage of the two clutches 24, 26 is precisely regulated during acceleration of the mill. In addition to regulating mill acceleration, the torque control also substantially eliminates cyclic load variations between the two motors, caused by gear wheel non-uniformity (usually eccentricity). The START button 61 thus simultaneously energizes both clutches 24, 26 to the predetermined start-up torque value, to provide starting torque as well as to accommodate cyclic load variations between the motors.

When the mill has been brought nearly up to full running speed, as sensed by the tachometer generator 17 it is necessary to lock-up the clutches and eliminate clutch slip if economic running is to be achieved. Simultaneous locking-up of the clutches 24, 26 is effected by actuating RUN button 63, which causes the mill regulator 60 to substantially instantly and simultaneously increase the torque-slip capacity of the clutches to a sufficient value such that no further slippage will occur under normal operating conditions.

A typical lock-up value for clutch torque might comprise 200% of normal full load torque. Thus, running normally at full speed in the locked-up condition, there would be no compensatory cyclic slippage of one clutch relative to the other, to effect load balancing and compensate for gear eccentricity. The lock-up condition thus ties motor load variation to the system torque transmission variations engendered by the cyclic variation present, due primarily to non-uniformity of the gear wheel.

It has been found in practice that the equalization of load between the motors is significantly affected by the particular instant at which lock-up takes place, relative to the rotation of the main gear wheel.

Thus it has been found that there is at least one position during the rotation of the large gear wheel at which, if lock-up is made coincident therewith, the variation in cyclic loading between the two driving motors will be minimal.

Correspondingly, there is at least one position on the rotation of the large gear whereat, if lock-up is made coincident therewith the cyclic variation in instantaneous loading between the two motors will be maximized.

The instantaneous load variation between the motors for intermediate lock-up positions will lie between the ideal and the worst case.

It has also been found that by initially marking the large gear at an arbitrarily selected spot 81 on its periphery, providing a pre-positioned datum pointer 80, and then completing clutch lock-up at the coincidence of the mark and the datum during the rotation of the large gear, that the recordal of instantaneous power consumption variations of the two motors will provide a cyclic load variation characteristic of the mill characteristic from which it is possible to accurately determine the gear position, relative to the arbitrary datum, at which the best operating condition can be achieved; and conversely the position of the large gear relative to the datum at which the least desired operating condition, in terms of cyclic variation in instantaneous motor loads, will obtain.

It will be understood, in obtaining a cyclic load variation characteristic of plant operation in this manner, that during the recordal of motor instantaneous loads no extraneous influence such as quadratoruqe motor regulation can be permitted, if a result is to be obtained for carrying out the presently disclosed procedure.

Figure 4:
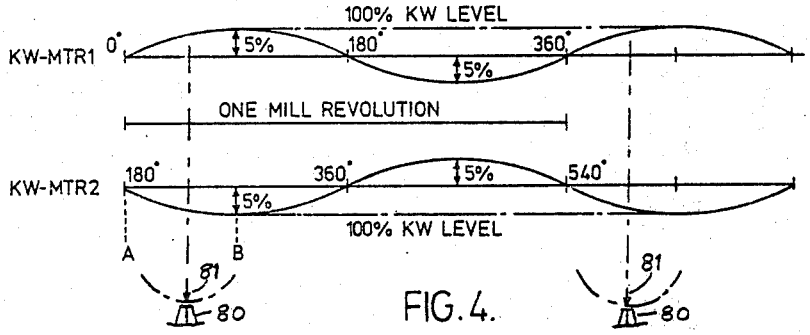
FIG. 4 is a typical load variation characteristic of cyclic power requirement for the illustrated arrangement.

Referring to FIG. 4 the respective sinusoidal load variation traces of instantaneous motor power consumption in kilowatts ("KW-Mtr. 1" and "KW-Mtr. 2") are illustratively graphed for Motor 1 and Motor 2, while the Event Marker is illustrated therebeneath, comprising the coincident point of the gear wheel mark and the fixed datum, when clutch lock-up is effected, the base distance between event marker points representing one complete revolution of the gear wheel.

From the illustrated cyclic trace it will be seen that the point of clutch lock-up, indicated by the first event marker almost coincided by happenstance with the preferred position of lock-up at point 'A', being some 30° to 40° thereafter, in terms of gear wheel rotation.

The illustrated sinusoidal variation represents an oscillation of approximately ±5% of average power. The median line for the cyclic load characteristic curve represents the Average Power Level (A.P.L.).

Relating the variation in instantaneous power to the cyclic load characteristic curves, changing the Event Marker the requisite amount can lead to achieving lock-up at the optimized 'A' position. This can be effected practically by repositioning the pointer 80 the requisite 30° around the periphery against the direction of rotation of the wheel, so as to advance the instant of lock-up.

By doing this, the values represented by the illustrated cyclic load characteristic curves for the optimized condition would approximate thus:

| Mill Position (Event Marker) | | Instantaneous Power Variation % from Average Power Level (APL) Motor 1 | Motor 2 | Total Mill Power | Difference in Instantaneous Motor Powers % |
|---|---|---|---|---|---|
| (A) | 0° | 0 | 0 | 2 × APL | 0 |
| | 90 | +5 | −5 | 2 × APL | 10 |
| | 180 | 0 | 0 | 2 × APL | 0 |
| | 270 | −5 | +5 | 2 × APL | 10 |
| | 360 | 0 | 0 | 2 × APL | 0 |

By locking up the clutches at the worst condition, represented by the position 'B', 90° after (or before) the position A, the following approximate instantaneous motor loads would obtain

| Mill Position (Event Marker) | | Instantaneous Power Variation % from Average Power Level (APL) Motor 1 | Motor 2 | Total Mill Power | Difference in Instantaneous Motor Powers % |
|---|---|---|---|---|---|
| (B) | 90° | +5 | −5 | 2 × APL | 10 |
| | 180 | −5 | +5 | 2 × APL | 10 |
| | 270 | −10 | +10 | 2 × APL | 20 |
| | 360 | −5 | +5 | 2 × APL | 10 |
| | 540 | 0 | 0 | 2 × APL | 0 |

Comparing these theoretical results, the variation in instantaneous loads of the motors is: Start Condition "A": 10% variation from Average Power Level (±5%) Start Condition "B": 20% variation from A.P.L. (±10%).

It will be understood that the figures used are illustrative of a typical situation, and are not authenticated.

It will be evident that once the cyclic load characteristic curves for of mill operation are determined, the point or the datum marker 80, or both, may be varied in order to facilitate clutch lock-up at the desired operating condition. Once established, the optimum lock-up point may then be readily reutilized during the life of the mill, by operating the RUN button 63 at the instant of coincidence of the mark on the gear with the fixed pointer.

It will be noted that the cyclic characteristic is probably influenced by the mechanical arrangement of the gear and pinions. Thus, in the illustrated arrangement having the pinions located in diametrically opposed relation on opposite sides of the main gear wheel 12, the occurrence of a repetitive electrical characteristic having a 180° period is not considered coincidental.

In an arrangement having the pinions arranged otherwise, such as at 120° and 270° from the main gear top dead centre, it is thought that only one optimum lock-up point per revolution would probably exist, or if two such points existed that they would have an interval other than 180°.

In addition to being used for selecting the optimum clutch lock-up position, the cyclic load characteristic determination technique also makes possible more accurate subsequent determinations of load sharing as an indication of wear between the gears, and the functional condition of the gears, for annual evaluations etc.

Use of the present invention may permit the utilization of lower cost synchronous motors, as compared with utilizing the more expensive quadra torque motor incorporating cyclic load compensation.

Figure 5:
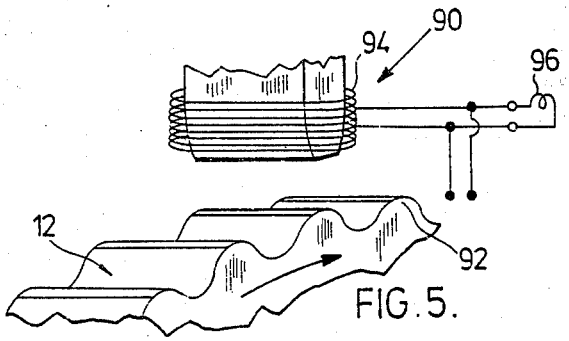
FIG. 5 is a scrap view showing a magnetic position detector embodiment.

Whilst the FIG. 3 embodiment relies upon a visual indicator for indicating the relative angular position of the large gear wheel 12, FIG. 5 illustrates that a magnetic indicator 90 may be used, shown as having a magnetic tooth 92 on the gear wheel 12, or equivalent, in combination with a detector coil 91 selectively positioned in the manner of the pointer 80, at the desired optimum position. Such an arrangement can be operated manually in response to lighting of the lamp 96, or used automatically for connection in electrically energizing the RUN condition mechanism, for automatic locking up of the clutches for minimum cyclic load imbalance.

What we claim as new and desire to secure by Letters Patent of the United States is:

1. A mill drive system having a mill drum rotatably mounted between spaced bearings, a large gear connected thereto in driving relation, at least two pinion gears mounted in constant meshing relation with the large gear, at least two electric motors to drive the respective pinion gears, variable clutches to permit variation in transmission of torque between each motor and the respective pinion gear, and regulating means for selectively controlling the clutches, said system being subject while under steady state operation to recurrent cyclic imbalance in the instantaneous values of electrical power required by said motors, angular position indicating means located at a predetermined angular position on the large gear and datum indicating means positioned in predetermined angular relation adjacent the large gear to provide indication of the coincidence of the indicating means, and clutch control means for effecting locking-up of the clutches at a preselected angular position of the gear wheel whereby the cyclic variation in load of the motors may be selectively moderated.

2. The mill drive system as claimed in claim 1, said angular indicating means and said datum indicating means including electrical proximity detecting means for actuating said clutch control means for initiating said locking-up of said clutches.

3. The method of controlling the operation of a large gear directly connected in driving relation with a load, in a system having individual selectively variable clutches interposed in controllable connecting relation between a pair of pinion gears connected in constant meshing relation with the large gear and an individual electric motor connected in driving relation with each pinion gear through a said clutch, having each said motors initially running at synchronous speed including the steps of operating said clutches in a slipping mode on start-up of the load to limit the respective torque transmitted to a predetermined load value, and to permit cyclic equalization of load between said motors and then locking up the clutches at a predetermined angular position of the large gear relative to a fixed datum to preclude further slip and to synchronize operation of the motors to the gear whereby cyclic variations of loading on the motors due to non-uniform characteristic of the large gear are substantially minimized.

4. The method as claimed in claim 3, said angular position being predetermined by the steps of obtaining a characteristic trace of instantaneous variations in the loads on said motors consequent on lock-up of the clutches at a known, arbitrarily selected angular position, selecting from said trace a modified value of said angular position to minimize the difference in cyclic loading between said motors and locking up said clutches at said selected angular position.

* * * * *